US006135198A

United States Patent [19]

Chu et al.

[11] Patent Number: 6,135,198

[45] Date of Patent: Oct. 24, 2000

[54] SUBSTRATE SYSTEM FOR SPRAY FORMING

[75] Inventors: Men G. Chu, Export; William P. Chernicoff, Harrisburg, both of Pa.

[73] Assignee: Aluminum Company of America, Pittsburgh, Pa.

[21] Appl. No.: 09/035,218

[22] Filed: Mar. 5, 1998

[51] Int. Cl.[7] ..... B22D 23/00

[52] U.S. Cl. ..... 164/429; 164/443; 164/46; 164/479

[58] Field of Search ..... 164/46, 429, 479, 164/463, 444, 272, 271, 455, 443

[56] References Cited

U.S. PATENT DOCUMENTS

| | | | |
|---|---|---|---|
| 3,612,158 | 10/1971 | Rossi | 164/138 |
| 4,074,747 | 2/1978 | Takahashi et al. | 164/443 |
| 4,522,784 | 6/1985 | Enright et al. | 420/590 |
| 4,580,614 | 4/1986 | Haissig | 164/154.1 |
| 4,749,027 | 6/1988 | Allyn et al. | 164/455 |
| 4,917,170 | 4/1990 | Sankaranarayanan et al. | 164/429 |
| 4,938,278 | 7/1990 | Sankaranarayanan et al. | 164/429 |
| 4,945,973 | 8/1990 | Ashok et al. | 164/429 |
| 5,143,146 | 9/1992 | Watson | 164/479 |
| 5,154,219 | 10/1992 | Watson et al. | 164/46 |
| 5,191,925 | 3/1993 | Sosin | 164/428 |
| 5,235,895 | 8/1993 | Vanark et al. | 89/36.02 |
| 5,240,061 | 8/1993 | Watson et al. | 164/46 |
| 5,251,687 | 10/1993 | Ashok et al. | 164/429 |
| 5,299,628 | 4/1994 | Ashok | 164/423 |

*Primary Examiner*—Harold Pyon
*Assistant Examiner*—I.-H. Lin
*Attorney, Agent, or Firm*—Debra Z. Anderson; Gary P. Topolosky

[57] ABSTRACT

A substrate system for receiving a deposit of sprayed metal droplets including a movable outer substrate on which the sprayed metal droplets are deposited. The substrate system also includes an inner substrate disposed adjacent the outer substrate where the sprayed metal droplets are deposited on the outer substrate. The inner substrate includes zones of differing thermal conductivity to resist substrate layer porosity and to resist formation of large grains and coarse constituent particles in a bulk layer of the metal droplets which have accumulated on the outer substrate. A spray forming apparatus and associated method of spray forming a molten metal to form a metal product using the substrate system of the invention is also provided.

7 Claims, 2 Drawing Sheets

SUBSTRATE SYSTEM FOR SPRAY FORMING

The Government of the United States of America has rights in this invention pursuant to Contract No. DE-FC07-94ID 1323 awarded by the U.S. Department of Energy.

BACKGROUND OF THE INVENTION

This invention relates to a substrate system for spray forming and an associated method.

Spray forming, also referred to as spray casting, of molten metal is a fairly well known process for producing various types of metal products. Spray forming consists of introducing a controlled stream of molten metal into a gas-atomizing nozzle where it is impacted by high-velocity jets of gas, usually argon or nitrogen. The resulting spray of metal droplets is deposited onto a substrate to form a highly dense product. See U.S. Pat. Nos. 4,938,278; 5,110,631; 5,143,140; and 5,154,219.

Various types of substrate problems exist in spray formed products. For example, one problem concerns a high degree of substrate layer porosity which is formed due to high chilling at the substrate layer at the leading edge of the spray. U.S. Pat. No. 4,917,170 recognizes the problem of substrate layer porosity and attempts to solve the problem by providing a low thermal conductivity substrate for use in the spray forming process. The substrate is made entirely of a low thermal conductivity material. U.S. Pat. No. 5,240,061 also recognizes the problem of substrate layer porosity in spray forming processes. A moving substrate in the form of a thin foil is provided to reduce and limit heat extraction from the particles being deposited on the substrate so as to reduce substrate layer porosity.

Another problem relates to inadequate heat extraction from a bulk layer of the sprayed metal droplets deposited on the substrate. Typically, slow cooling rates in the bulk layer results in coarse constituent particles and large grains. As can be appreciated, this problem is enhanced by substrate designs aimed primarily at resolving the problem of substrate layer porosity. In other words, a substrate system which reduces the problem of substrate layer porosity enhances the problem of inadequate heat extraction from the bulk layer, while a substrate system that reduces the problem of inadequate heat extraction from the bulk layer enhances the problem of substrate layer porosity.

What is needed, therefore, is a substrate system for spray forming molten metal droplets to form a metal product that effectively solves both problems of substrate layer porosity and inadequate heat extraction from the bulk layer. Such a substrate system would serve to eliminate or significantly reduce both porosity in the substrate layer and reduce grain size and constituent particle size in the bulk layer by providing more efficient heat extraction rates to the bulk layer region.

SUMMARY OF THE INVENTION

The invention has met or exceeded the above-mentioned needs, as well as others.

A substrate system for receiving a deposit of sprayed metal droplets comprises a movable outer substrate on which the sprayed metal droplets are deposited and an inner substrate disposed adjacent the outer substrate where the sprayed metal droplets are deposited on the outer substrate. The inner substrate includes zones of differing thermal conductivity. Preferably, the zones of differing thermal conductivity include a low thermal conductivity zone, an intermediate thermal conductivity zone, and a high thermal conductivity zone. The low thermal conductivity zone is disposed adjacent the outer substrate at a location where a leading edge of the sprayed metal droplets are deposited on the outer substrate. Advantageously, this prevents chilling at the substrate layer and eliminates or significantly reduces substrate layer porosity. The high thermal conductivity zone is disposed adjacent the outer substrate at a location where a bulk layer of the sprayed metal droplets have accumulated on the outer substrate. Advantageously, this provides for rapid heat extraction from the bulk layer so as to prevent the development of coarse constituent particles and large grains in the product being produced. The intermediate thermal conductivity zone is disposed between the low thermal conductivity zone and the high thermal conductivity zone and provides a transition area therebetween.

A spray forming apparatus is also disclosed which includes an atomizing spray nozzle for creating a spray of metal droplets and a substrate system for receiving a deposit of the sprayed metal droplets. As described above, the substrate system includes a movable outer substrate on which the sprayed metal droplets are deposited and an inner substrate disposed adjacent the outer substrate and having zones of differing thermal conductivity.

A method of spray forming a molten metal to form a metal product is also provided. The method first includes atomizing the molten metal to produce sprayed metal droplets and then depositing the sprayed metal droplets onto a movable substrate such that porosity in a substrate layer of the metal product is resisted and further, such that grain size in a bulk layer adjacent the substrate layer is reduced. Preferably, the method provides for employing aluminum as the molten metal.

A further method of spray forming a molten metal to form a metal product includes atomizing the molten metal to produce sprayed metal droplets and then depositing the sprayed metal droplets onto an outer movable substrate overlying an inner substrate having zones of differing thermal conductivity.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
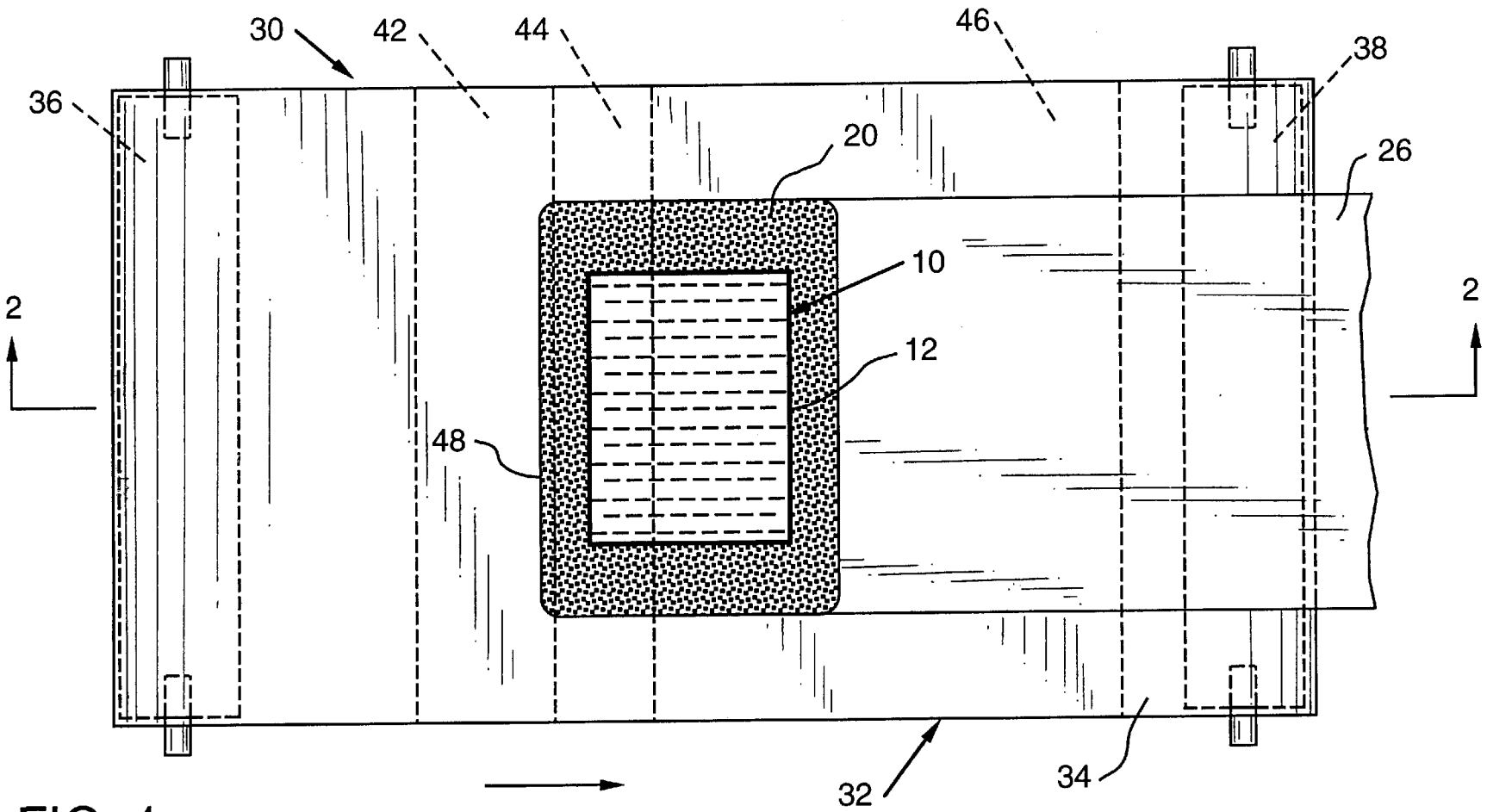
FIG. 1 is a plan view of the substrate system of the invention and associated spray forming apparatus.
Figure 2:
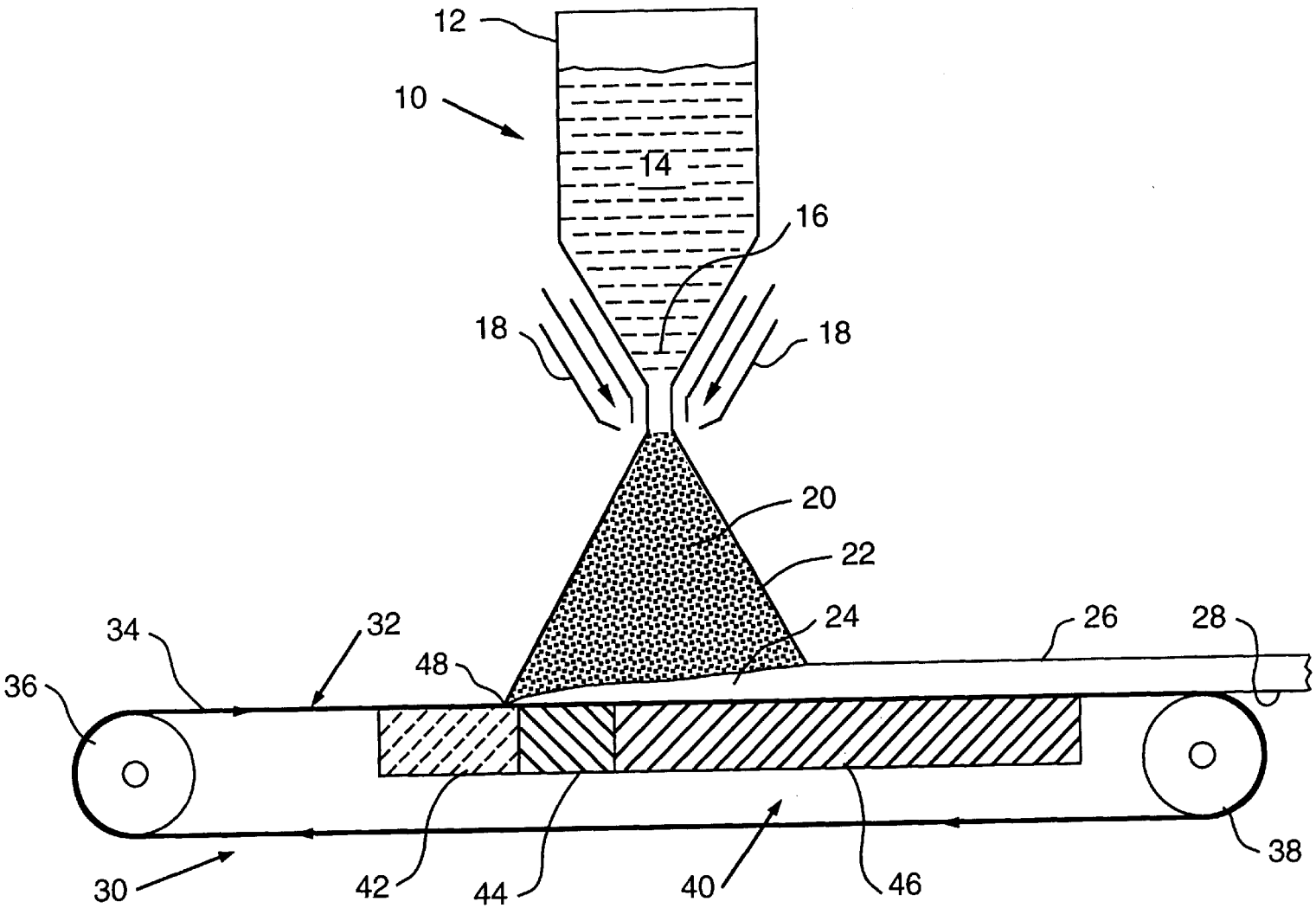
FIG. 2 is a sectional view taken along line 2—2 of FIG. 1.

Referring to FIGS. 1 and 2, an embodiment of the invention will be discussed. Specifically, the invention includes a substrate system for receiving a deposit of sprayed metal droplets from a spray forming apparatus to form a metal product.

The spray forming apparatus, generally referred to by the reference numeral 10, may be a typical spray forming apparatus as is known in the art and include a tundish 12 having molten metal 14 contained therein. The molten metal 14 is discharged from the tundish 12 at a discharge end thereof by nozzle 16 such as for example, a linear or circular nozzle as is known in the art. The molten metal 14 is then impinged upon by high-velocity jets of gas 18 (usually argon or nitrogen) which emanates from an atomizer (not shown). The jets of gas 18, in turn, atomize the molten metal 14 being discharged from the discharge end portion of the tundish 12 by nozzle 16 to form numerous metal droplets 20. The metal droplets 20 form a "tent" 22 of molten metal droplets that are to be deposited onto a substrate as will be discussed in detail herein below.

In accordance with an important aspect of the present invention, a unique substrate system, generally designated by reference numeral 30, is provided for receiving a deposit of the sprayed metal droplets 20 resulting in the formation of a bulk layer 24 of the metal droplets 20 to produce a metal product, such as a metal sheet 26. Advantageously, the unique substrate system 30 of the invention resists the formation of porosity in a substrate layer 28 while at the same time providing for adequate heat extraction from the bulk layer 24 so as to reduce grain size and constituent particle size in the bulk layer 24.

Specifically, the substrate system 30 includes a movable outer substrate 32 onto which the sprayed metal droplets 20 are deposited. The outer substrate 32 includes an endless belt 34 orbiting, preferably while under tension, around two rollers 36 and 38. Preferably the endless belt 34 has a thickness in the range of about 0.005 to 0.01 inches. Further, the thickness of the endless belt 34 is dependent upon the percent liquid of the impinging metal droplets 20. Also, the thickness of the endless belt 34 is dependent upon the operating temperature of the endless belt 34. Specifically, the endless belt preferably has an operating temperature in the range of about 200 to 300° C. As is generally known, the endless belt 34 may be heated by: (i) heating the endless belt 34 in a controlled atmosphere in which the spray forming process is taking place (not shown); or (ii) by using an inline heating system to heat the endless belt 34 (not shown).

Once the metal sheet 26 is separated from the outer substrate 32, and more specifically is separated from the endless belt 34, the metal sheet 26 may be further processed by, for example, being either coiled or rolled in a rolling mill (not shown).

The substrate system 30 also includes an inner substrate, generally designated by the reference numeral 40, disposed adjacent the outer substrate 32 at a location where the sprayed metal droplets 20 are deposited on the outer substrate 32. The inner substrate includes a low thermal conductivity zone 42, an intermediate thermal conductivity zone 44, and a high thermal conductivity zone 46 in order to provide for varying rates of heat extraction from the sprayed metal droplets 20 beginning at a leading edge 48 of the sprayed metal droplets 20 and continuing to bulk layer 24 which accumulate on the outer substrate 32 as the endless belt 34 continues to pass beneath the spray forming apparatus 10. The inner substrate 40 may be mounted adjacent the belt 34 by any appropriate means, such as, for example, legs extending to the floor (not shown) or mounting to a wall (not shown).

The low thermal conductivity zone 42 is disposed adjacent the outer substrate 32 at a location where the leading edge 48 of the sprayed metal droplets 20 are deposited onto the endless belt 34 of the outer substrate 32. Preferably, the low thermal conductivity zone 42 has a thermal conductivity in the range of about less than or equal to 1.0 $W/m^2sec$. Additionally, the low thermal conductivity zone 42 is preferably formed from a material selected from the group consisting of refractory ceramics. Advantageously, by providing for the low thermal conductivity zone 42 adjacent the outer substrate 30 at a location where the leading edge 48 of the sprayed metal droplets 20 are deposited onto the endless belt 34, heat extraction is minimized from the substrate layer 28 allowing for a uniform, non-porous layer of the metal droplets 20 to be deposited onto the endless belt 34. The endless belt 34 slides over the low thermal conductivity zone 42 and preferably is in surface-to-surface contact therewith as the endless belt continues to orbit around the rollers 36 and 38. By providing belt 34 under tension, surface-to-surface contact may be maintained while eliminating air gaps between the belt 34 and inner substrate 40. Therefore, it will be appreciated that the low thermal conductivity zone prevents a high chilling rate at the substrate layer 28 along the leading edge 48 of the sprayed metal droplets 20 which if not controlled can result in a high degree of porosity in the substrate layer 28.

The high thermal conductivity zone 46 is disposed adjacent the outer substrate 32 where the bulk layer 24 of the sprayed metal droplets 20 have accumulated on the endless belt 34. The high thermal conductivity zone 46 preferably has a thermal conductivity in the range of about greater than or equal to 400 $W/m^2sec$. Furthermore, the high thermal conductivity zone 46 is preferably formed from a material selected from the group consisting of water cooled steel, water cooled copper and water cooled aluminum and its alloys. As opposed to the minimal heat extraction necessary at the leading edge 48 of the sprayed metal droplets 20 in order to prevent the formation of porosity in the substrate layer 28, it is desirable to provide for increased heat extraction from the bulk layer 24 to prevent formation of coarse constituent particles and large grains in the bulk layer 24. Advantageously, the increased heat extraction at this point in the spray forming process is achieved by the present invention as a result of the high thermal conductivity zone 46 being positioned in a surface-to-surface contact with the bulk layer 24. The increased heat extraction from the bulk layer 24 results in rapid quenching of the sprayed metal droplets which make up the bulk layer 24 thereby reducing the size of the grains and constituent particles.

The intermediate thermal conductivity zone 44 is disposed between the low thermal conductivity zone 42 and the high thermal conductivity zone 46. The intermediate thermal conductivity zone preferably has a thermal conductivity in the range of about 30 to 230 $W/m^2sec$. Additionally, the intermediate thermal conductivity zone 44 is preferably formed from a material selected from the group consisting of steel, copper, and aluminum and its alloys. The intermediate thermal conductivity zone 44 is positioned between the low thermal conductivity zone 42 and the high thermal conductivity zone 46 to prevent buckling of the deposit of sprayed metal droplets which make up the bulk layer 24 due to rapid thermal contraction. Therefore, the intermediate thermal conductivity zone 44 provides a smooth transition for the deposit of sprayed metal droplets as it progresses from the low thermal conductivity zone 42 to the high thermal conductivity zone 46.

The exact positioning of the different zones 42,44, and 46 and the lengths thereof is dependent upon such factors as, for example, the thickness of the metal sheet 26 being produced, the particular metal or alloy being used, and the operating parameters of the process such as temperature of the molten metal 16 and belt temperature.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A substrate for receiving a deposit of sprayed metal droplets, said system comprising:

an outer substrate on which said sprayed metal droplets are deposited, said outer substrate being movable; and an inner substrate comprising a low thermal conductivity zone having a thermal conductivity in the range of about less than or equal to 1.0 $W/m^2sec.$, an intermediate thermal conductivity zone having a thermal conductivity in the range of about 30 to 230 $W/m^2sec.$, and a high thermal conductivity zone having a thermal conductivity in the range of about greater than or equal to 400 $W/m^2sec$, wherein said low thermal conductivity zone is disposed adjacent said outer substrate where a leading edge of said sprayed metal droplets are deposited on said outer substrate, said high thermal conductivity zone is disposed adjacent said outer substrate where a bulk layer of said sprayed metal droplets have accumulated on said outer substrate, and said intermediate thermal conductivity zone is disposed between said low thermal conductivity zone and said high thermal conductivity zone.

2. The substrate system of claim 1 wherein said outer substrate is an endless belt.

3. The substrate system of claim 2 wherein said endless belt has a thickness in the range of about 0.005 to 0.01 inches.

4. The substrate system of claim 1 wherein said low thermal conductivity zone is formed from a refractory ceramic material.

5. The substrate system of claim 1 wherein said high thermal conductivity zone is formed from a material selected from the group consisting of water cooled steel, water cooled copper, and water cooled aluminum and its alloys.

6. The substrate system of claim 1 wherein said intermediate thermal conductivity zone is formed from a material selected from the group consisting of steel, copper, and aluminum and its alloys.

7. The substrate system of claim 1 wherein the sprayed metal droplets are aluminum.

* * * * *